US008905587B1

(12) United States Patent
Bouckaert

(10) Patent No.: US 8,905,587 B1
(45) Date of Patent: Dec. 9, 2014

(54) INTERNAL COVERT IR FILTER FOR SEARCHLIGHT SYSTEMS

(75) Inventor: Anton M. Bouckaert, Simi Valley, CA (US)

(73) Assignee: The Boeing Company, Chicago, IL (US)

( * ) Notice: Subject to any disclaimer, the term of this patent is extended or adjusted under 35 U.S.C. 154(b) by 159 days.

(21) Appl. No.: 13/206,208

(22) Filed: Aug. 9, 2011

(51) Int. Cl.

| | |
|---|---|
| ***F21S 8/00*** | (2006.01) |
| ***F21V 9/00*** | (2006.01) |
| ***F21V 11/00*** | (2006.01) |
| ***F21V 9/04*** | (2006.01) |
| ***F21S 8/10*** | (2006.01) |

(52) U.S. Cl.
CPC ..... *F21V 9/04* (2013.01); *F21S 48/1136* (2013.01)
USPC ..... 362/277; 362/583; 362/293; 362/539

(58) Field of Classification Search
CPC ..... F21S 48/1136; F21V 9/04
USPC ..... 362/277, 293, 583
See application file for complete search history.

(56) References Cited

U.S. PATENT DOCUMENTS

| | | | | |
|---|---|---|---|---|
| 5,695,272 | A | 12/1997 | Snyder et al. | |
| 5,735,594 | A * | 4/1998 | Own | 362/202 |
| 5,882,107 | A | 3/1999 | Bornhorst et al. | |
| 6,068,385 | A | 5/2000 | Hsieh | |
| 6,644,840 | B2 * | 11/2003 | Yagi et al. | 362/510 |
| 6,962,423 | B2 | 11/2005 | Hamilton et al. | |
| 7,021,804 | B2 * | 4/2006 | Van Duyn | 362/516 |
| 7,033,051 | B2 * | 4/2006 | Choi | 362/508 |
| 7,331,692 | B2 | 2/2008 | Baiardi et al. | |
| 7,518,133 | B2 | 4/2009 | Giffen et al. | |
| 8,292,479 | B2 * | 10/2012 | Sazuka et al. | 362/511 |
| 2001/0019482 | A1 * | 9/2001 | Kobayashi et al. | 362/510 |
| 2002/0154513 | A1 * | 10/2002 | Yagi et al. | 362/510 |
| 2005/0052869 | A1 * | 3/2005 | Brenner et al. | 362/293 |

FOREIGN PATENT DOCUMENTS

WO 2004/023036 3/2004

OTHER PUBLICATIONS

Revue Thommen AG Product Presentation: Thommen HSL 1600 (Apr. 14, 2011).

Press Release, "Revue Thommen displays the HSL-1600 helicopter searchlight," http://www.shephard.co.uk/news/rotorhub/revue-thommen-displays-the-hsl-1600-helicopter-searchlight/8146/ (Jan. 20, 2011).

Press Release, "Revue Thommen Displays the HSL-1600 Helicopter Searchlight at ALEA in New Orleans," http://www.rotorpad.com/manufacturers/revue-thommen-displays-the-hsl-1600-helicopter-searchliqht-at-alea-in-new-orleans.html (Jul. 20, 2011).

(Continued)

*Primary Examiner* — David J Makiya
(74) *Attorney, Agent, or Firm* — Clifford G. Cousins

(57) ABSTRACT

Described in this application for patent is a novel method and apparatus for modifying a searchlight from a visible-light source to an infrared source. This selective filtering is accomplished by means of a partially filtered cover about the light source which may be moved between first and second positions. In a first position, light projected by the light source passes through an unfiltered section of the lamp cover. In a second position, light projected by the light source passes through a filtered section of the lamp cover.

20 Claims, 5 Drawing Sheets

(56) References Cited

OTHER PUBLICATIONS

Web page featuring "HeliLight 1®," by Universal Searchlights, LLC, http://www.universalsearchlights.com/helilight.html (2009).

Product literature for "Trakkabeam®—M800," by Trakka Corp. Pty. Ltd., http://www:trakkacorp.com/tc/pdf/M800Brochure2006 (2009).

Product literature for "Trakkabeam®—M500," by Trakka Corp. Pty. Ltd., http://www.trakkacorp.com/tc/pdf/M500Brochure2006.pdf (2009).

Product literaure for Trakkabeam® A800, by Trakka Corp.Pty. Ltd., http://www.trakkacorp.com/tc/pdf/a800brochure2006.pdf (2009).

Product literaure for Trakkabeam® A800, by Trakka Corp.Pty. Ltd., http://www.trakkacorp.com/tc/pdf/A800Brochure2010_letter.pdf.

* cited by examiner

INTERNAL COVERT IR FILTER FOR SEARCHLIGHT SYSTEMS

BACKGROUND

The present invention relates to searchlights and more particularly to covert infrared filters for selectively filtering the light source of a searchlight.

Vehicles, such as aircraft, generally have lights mounted thereon for providing illumination during take-off, landing, or during search operations. The lights may also be useful for identifying aircraft or providing primary or supplemental lighting during operation of the aircraft in adverse conditions, including night operations, rain, and other particle storms. Alternatively, searchlights may be hand held or used in a smaller configuration, such as a flashlight, headlamp, or night vision imaging device.

With the advent of night vision imaging systems for covert operations, a need has arisen for landing lights, searchlights, and portable light sources that are compatible with night vision by producing infrared light. While separate infrared and visible spectrum lights may accomplish these objectives, there has been recognized a need in the art for a light source which may be converted between infrared and visible illumination.

One method of early convertible night-vision compatible lighting systems utilized a filter over the searchlight cover that allows only infrared light to pass through the filter. This type of filter, however, may be undesirable because of the difficulty in removing or altering the filter, requiring manual access to the searchlight. This limitation restricted the usefulness of the product by limiting flights to either visible-light or infrared-light.

A further improvement was the use of a lamp within a lighting system that has both a visible and an infrared filaments, allowing the operator to switch between the two. Further controls allowed the lamp head to be extended, retracted, and rotated through the use of electrical relays and a selector switch. One example of this improvement is described in U.S. Pat. No. 5,695,272 to Snyder et al.

This improvement allowed significant advantages over the prior art, including the ability to switch between the infrared and visible light spectrum from within the cockpit, thereby eliminating the need to manually remove and replace the searchlight cover to switch modes. However, these lamps do not emit the same intensity as a dedicated infrared or visible light system as the bulb surface is divided between infrared and visible light filtering covers.

U.S. Pat. No. 6,962,423 to Hamilton et al. describes another multi-mode visible and infrared lighthead for use as a landing light or searchlight. This patent describes two separate diodes, one for emitting infrared and the other for emitting visible light, spaced apart in a searchlight with each diode having its own reflector and lens cover. However, this arrangement similarly limits the amount of light that may be transmitted from the searchlight by dedicating a portion of the light-producing elements to only the infrared or visible spectrum.

Another dual mode searchlight is described in U.S. Pat. No. 7,518,133 to Giffen et al. This integrated searchlight lighthead includes separate infrared and visible light illumination sources each positioned within a reflector. The reflectors are merged and separated by an insulating material and air gap, providing cooling of the illumination sources. The merged reflector assembly provides an improved light distribution over previous light sources. However, the merged reflectors are inferior to a single reflector and the combination of separate lighting elements reduces the intensity of the light that may be produced.

Therefore, there has been recognized a need in the art for an improved searchlight capable of selectively transmitting infrared or visible light. There is further a need in the art for an improved searchlight which can be easily switched between infrared and visible illumination without the need for modification of the searchlight housing or cover. Finally, there is a need in the art for an improved searchlight which improves light distribution and efficiency.

SUMMARY

According to one embodiment of the following description a method for converting the light output from a searchlight from a first light profile to a second light profile is disclosed. This method generally requires the steps of providing a searchlight that includes a reflector and a lamp. A substantially cylindrical lamp cover is positioned about the lamp that includes a first portion and a second portion. Light projected through the first section conforms to the first light profile and light projected through the second section conforms to the second light profile. The lamp cover may be moved from a first position where light shines through the first position to a second position where light shines through the second portion. In this manner, the light is converted from the first light profile to the second light profile.

Further improvements on this apparatus include providing that the first portion may be clear glass with no filtering elements and the second portion may be glass having an infrared filtering component. Other arrangements and filters are anticipated as well.

According to a further embodiment, the following description describes an apparatus for providing either filtered or unfiltered light. The apparatus generally includes a bowl-shaped reflector with an interior and an edge, a lamp within the interior of the reflector surface, a cover about the edge of the reflector, and a lamp cover about the lamp. The lamp cover may include first and second sections having different light filtering characteristics. An actuator is further included that moves the lamp cover from a first position to a second, such that in the first position light is projected from the lamp through the first section and in the second position light is projected from the lamp through the second section.

According to further embodiments, the first portion may include no filtering characteristics and the second portion may include infrared-pass filtering characteristics. The lamp may also be attached to the actuator so that the lamp, lamp cover, and actuator may all be moved relative to the reflector. Other arrangements and filters are anticipated.

According to yet another embodiment, a method of manufacture is described. This method includes the steps of providing a number of optically transparent flat segments and coating to a portion of the flat segments. The segments are arranged in a substantially circular arrangement to form a lamp cover that can be moved to expose a lamp in a spotlight to either the transparent or coated portions of the flat segments. This provides selective filtering for the lamp and spotlight.

The features, functions, and advantages that have been discussed can be achieved independently in various embodiments of the present invention or may be combined in yet other embodiments further details of which can be seen with reference to the following description and drawings.

DETAILED DESCRIPTION

Figure 1:
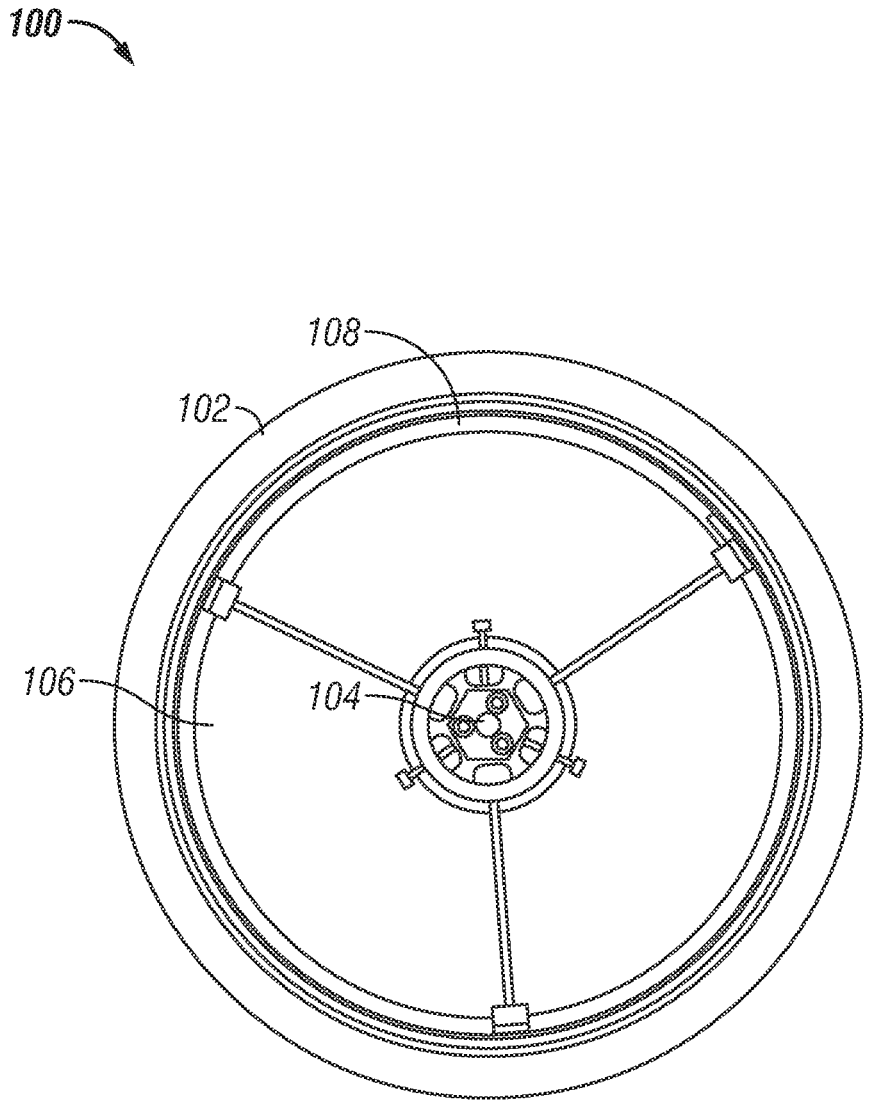
FIG. 1 is a plan view of a searchlight according to one embodiment.

FIG. 1 illustrates one embodiment of the searchlight 100 including a housing 102, light source 104, reflector 106, and a lens or cover 108. Not shown in FIG. 1, but illustrated in detail in FIGS. 2-7, is an improved light cover 110 about the light source 104 for selective filtering of light emitted by the source.

Figure 2:
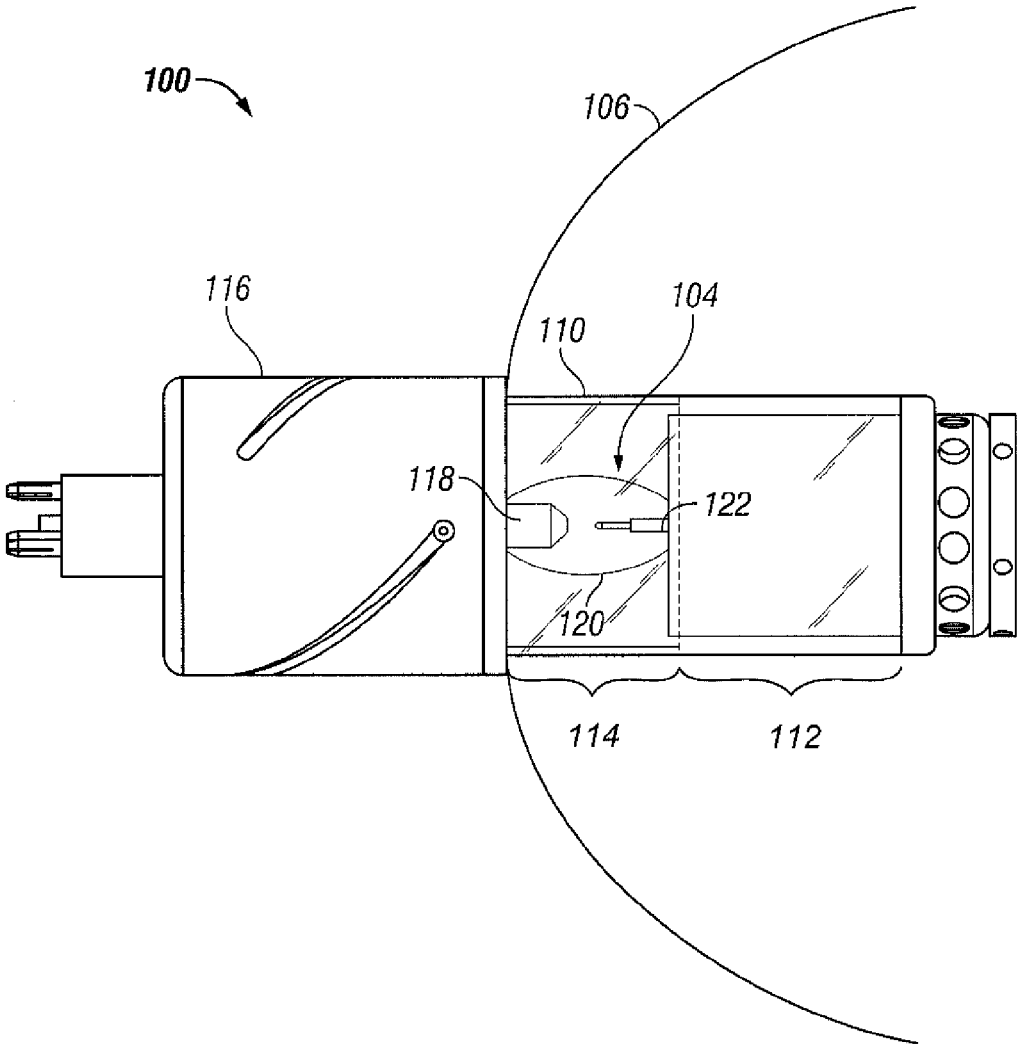
FIG. 2 is a side cutaway view of the searchlight.

FIG. 2 shows a cutaway view of the searchlight 100 with the housing 102 and cover 108 removed. As shown in this figure, the reflector 106 generally consists of a parabolic shape which may be formed of a highly reflective material (such as nickel) or include a highly reflective coating on the inner surface of the reflector 106. Those skilled in the art will recognize that the reflector 106 may take on various cross-sectional shapes, including semi-circular or elliptical. Further, the material or coating for the reflector 106 may be selected to meet design objectives.

The light source 104 may be generally selected to be a high efficiency and ultra-bright lamp. For example, light source 104 may be a xenon arc lamp that utilizes electricity to excite ionized xenon gas to produce a bright white light between two electrodes. Other lamps, including metal halide, mercury arc, sodium vapor, or other high intensity discharge (HID) lamps may be utilized in the searchlight. Other non-HID lamps may be utilized as well, including light emitting diodes (LEDs), fluorescent, or incandescent bulbs may be used without departing from the scope of the disclosure. In the illustrated embodiment, the light source 104 is shown at the focal point of the parabola shape of the reflector 106, however those having skill in the art will recognize that the light source 104 is movable away from the focal point of the reflector 106 to focus or widen the light projected from the searchlight.

Figure 3:
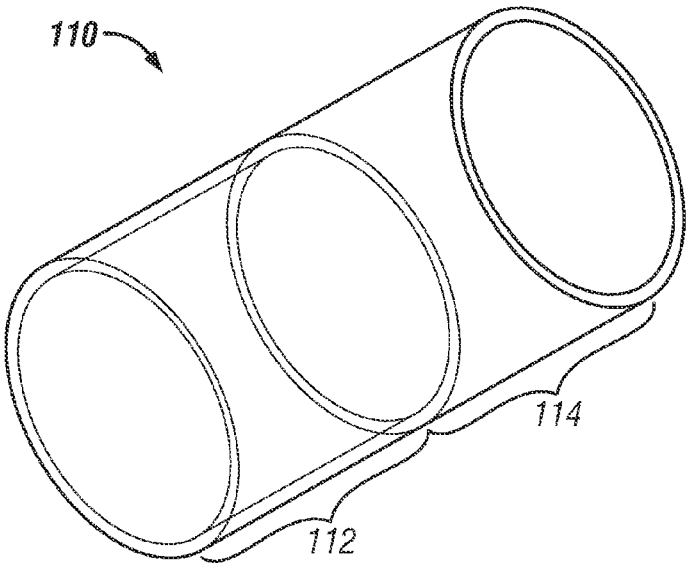
FIG. 3 is a perspective view of a light cover according to one embodiment.

Shown in FIG. 3 is the light cover 110 which substantially encircles the light source 104 (FIG. 2). This light cover 110 may include a clear section 112 and a filtering section 114. The clear section 112 is designed to allow all wavelengths of light from the light source 104 to pass through the light cover 110, allowing the searchlight to be used in a normal operating mode. The filtering section 114 is positioned on a separate part of the light cover 110 and only allows selective wavelengths of light to pass through the cover 110. According to one embodiment, the filtering section 114 may include an infrared filter, preventing visible and ultraviolet light from passing through the light cover 110 while allowing infrared light to pass through.

As further shown in FIG. 3, the light cover 110 may be a substantially cylindrical cover, comprised of a transparent material to provide a clear portion 112. A filtering material may be applied to provide a filtering portion 114 of the light cover 110. The light cover 110 is shown as having a generally cylindrical shape with a circular cross section but it is contemplated that the light cover 110 may comprise a variety of cross sections, including but not limited to continuous or non-continuous curves, regular and irregular geometric figures, and symmetrical or non-symmetrical curves, including ellipses or other closed figures. Further, while the light cover 110 is shown as having a consistent cross section across its entire length, it is contemplated that the light filter may have a continuous or varied cross section along its length, including a narrowing, widening, or otherwise geometrically changing cross section.

The use of distinct clear and infrared-filtering sections on the light cover is merely exemplary, and other combinations may be utilized without departing from the scope of the disclosure. Other filters or shutters for limiting the wavelengths or amount of light that passes through the light cover 110 will be known to those having skill in the art, and may include some combination of a clear, colored, ultraviolet, infrared, or multiple-wavelength light filter. Further, the light cover 110 is not limited to two separate and distinct regions. It is contemplated that three or more regions, including gradual filtering from one region to the next, may be utilized in combination with the light cover 110, or that several filtered layers may be stacked to allow for varied filtering options.

Figure 4:
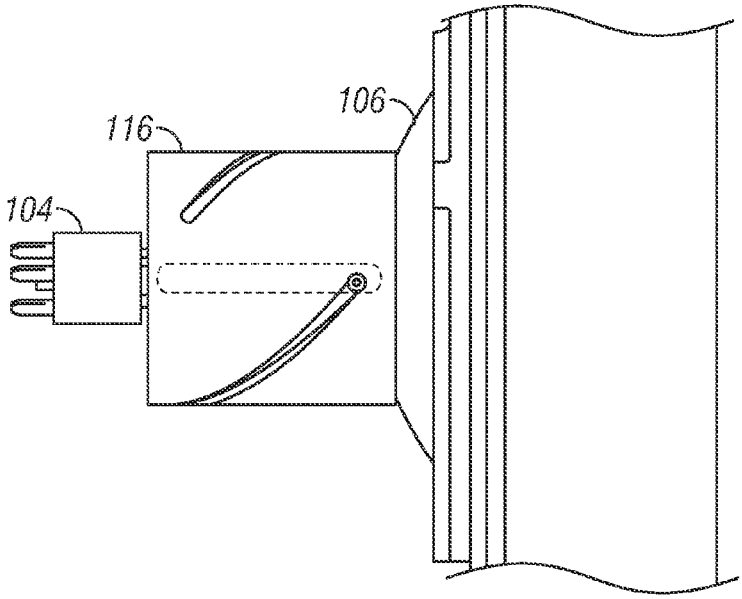
FIG. 4 is a side plan view of the searchlight light source and actuator.
Figure 5A:
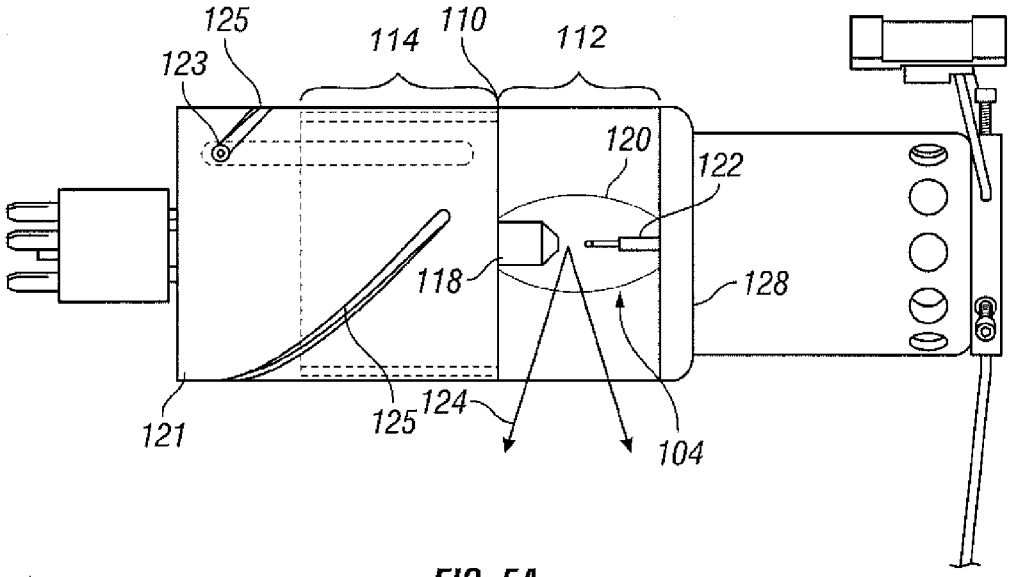
FIG. 5A is a side plan view of the light cover and actuator in a first arrangement.
Figure 5B:
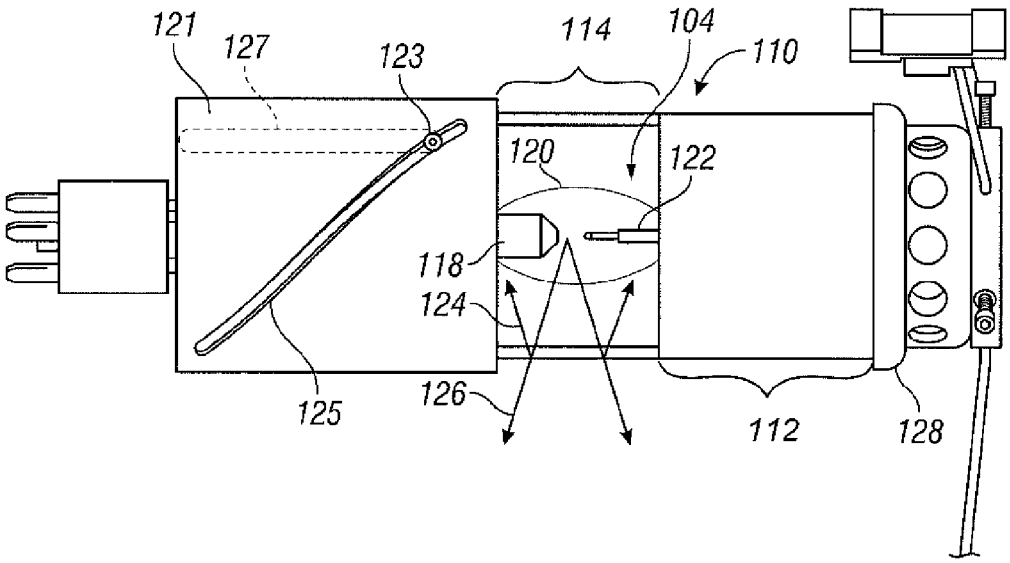
FIG. 5B is a side plan view of the light cover and actuator in a second arrangement.

In order to switch between the clear 112 and infrared 114 sections of the light cover 110, the light cover 110 must be moved relative to the bulb by means of an actuator 116 shown in FIGS. 4 and 5A-B, such as an electronic actuator. This actuator 116 positions the light cover 110 so that the preferred portion, whether it is the clear 112 or infrared-filtering 114 portion, substantially surrounds the light source 104.

As shown in FIG. 4, the actuator is generally positioned outside of the reflector 106 and is movable with the light source 104 relative to the reflector. This arrangement allows the filter and light source to move together to adjust the light output of the searchlight as the beam is narrowed or widened. This prevents light leakage from around either the clear section 112 or filtering section 114 of the light cover 110 when the light source 104 is moved, which may be undesirable depending on the use of the searchlight.

FIGS. 5A and 5B illustrate a side cutaway view of the reflector 100 showing the light cover 110 in a first (FIG. 5A) and second (FIG. 5B) position, thereby exposing the light source 104 to the clear 112 and filtering 114 sections of the cover 110.

As shown in FIG. 5A, the light cover 110 is in a first position whereby the clear section 112 of the light cover 110 surrounds the light source 104. The light source 104 may generally consist of an anode 118, a glass bulb 120, and a cathode 122 opposite the anode 118. To generate light, as is well known in the art, an electrical current is passed from the anode 118 to the cathode 122 and exciting the gas within the glass bulb 120. When excited, xenon gas creates a bright white light that radiates away from the gas and through the glass bulb 120. While white light produced from xenon is one embodiment, it is understood that other gas sources may be used to create other colors of light.

As further shown in FIG. 5A, light rays 124 are emitted from the glass bulb 120 and extend radially away from the bulb 120. The light rays 124 then pass through the light cover 110 and are reflected off of the reflector 106 (FIG. 2). The reflector 106 is generally shown to be a parabolic reflector which aligns light rays 124 to be substantially parallel as they pass through the cover 108. In the arrangement shown in FIG. 5A, the clear portion 112 of the light cover 110 is positioned about the light source 104, allowing light rays 124 of all wavelengths to pass through the light cover 110.

FIG. 5B shows the light cover 110 in a second position where the filtered portion 114 of the light cover 110 substantially covers the light source 104, or more particularly, the gas-filled light emitting glass bulb 120. As shown in this figure, light rays 124 are emitted from the xenon gas within the glass bulb 120 as described above. However, a layer of filtering material on the filtered portion 114 of the light cover 110 absorbs or reflects non-preferred wavelengths of light. In the example described, this filter allows only infrared light to pass through while reflecting or absorbing non-infrared light. Rays of infrared light 126 are then reflected from the reflector surface 106 and pass through the cover 108.

Figure 6:
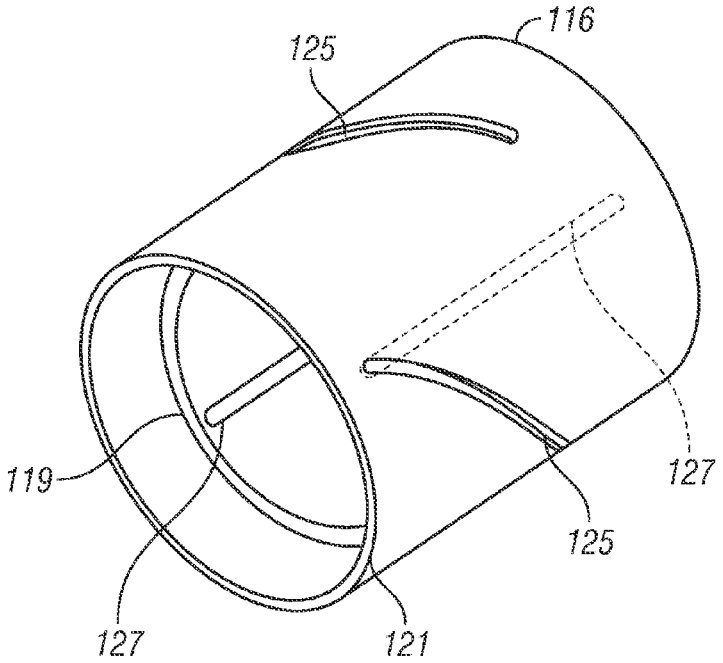
FIG. 6 is a perspective view of the actuator.

Shown in further detail in FIG. 6 is the actuator 116 which controls the position of light cover 110. This actuator 116 moves the light cover 110 from the first to second position so that rays of light 126 engage either the clear section 112 or filtering section 114 of the light cover 110. In the embodiment illustrated the actuator 116 includes a motor (not shown), inner sleeve 119 and outer sleeve 121. The outer sleeve 121 includes a spiral slot 125 that extends radially and axially about the outer sleeve 121. The inner sleeve 119 includes a straight slot 127 that extends only axially about the inner sleeve. As shown in FIGS. 5A-B, an anchor 123 is provided on the light cover 110 that extends through the spiral 125 and straight 127 slots. The slots 125, 127 are sized to approximately the same size as the anchor 123, and therefore movement of the anchor is constrained by the positions of the inner 119 and outer sleeves 121 to each other. According to the embodiment illustrated, the motor may be connected alternatively to the inner 119 or outer 121 sleeves to rotate one relative to the other when the motor is engaged. Because the slots 125, 127 constrain the position of the anchor 123, as the outer sleeve 121 is rotated relative to the inner sleeve 119, the anchor traverses the spiral slot 125 radially while traversing the straight slot 127 axially. These two slots therefore control the position of the light cover 110 between the positions shown in FIGS. 5A-B. Other methods of adjusting the position of the lamp cover 110 are contemplated in the present disclosure and will be appreciated by those having skill in the art. These methods may include a worm gear, screw, belt, cam, or other method of translating the light cover 110 that may be apparent to those having skill in the art.

In the embodiments illustrated, reflector 106 and actuator 116 are coupled to move with one another. This coupling allows adjustment of the light source 104 relative to the reflector 106 without adjusting the position of the reflector 106 relative to the light cover 110. This is to maintain the integrity of the light seal 128 (FIGS. 5A and 5B) around the light cover 110, preventing light of unwanted wavelengths from leaking out, which may compromise the purpose of utilizing an infrared filter.

Figure 7A:
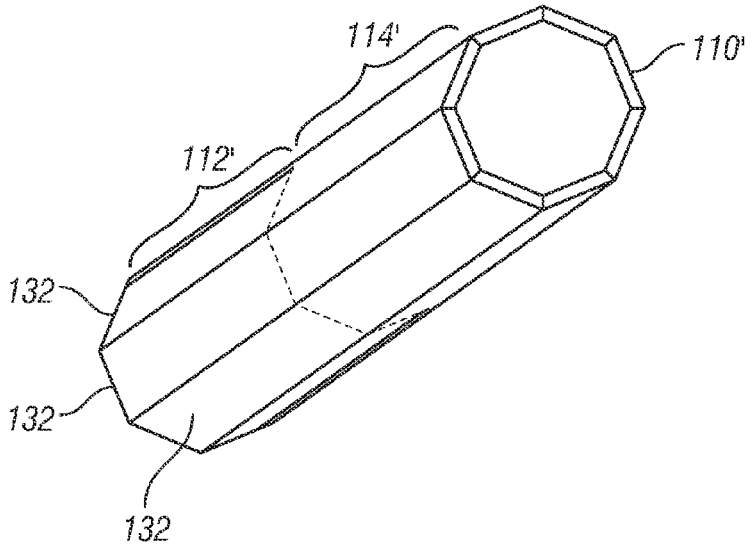
FIG. 7A is a perspective view of an alternative embodiment of the light cover.
Figure 7B:
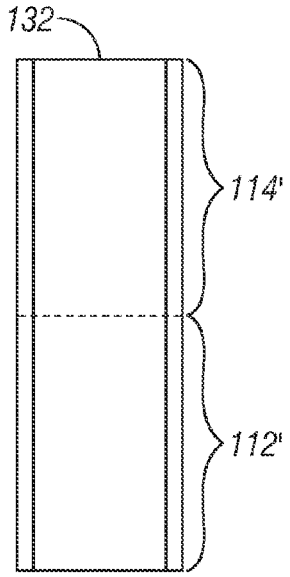
FIG. 7B is a top plan view of a section of the light cover shown in FIG. 7A.

FIG. 7A shows a perspective view of an alternative embodiment of the light cover 110. The light cover 110 preferably includes a clear portion 112 and a filtered portion 114 adjacent to one another such that the light cover 110 may selectively filter a light source 104 (FIG. 2). In this embodiment, the light cover 110 may be constructed from a number of multiple flat segments 132. An exemplar of these multiple flat segments 132 is shown in FIG. 7B. Each segment 132 may include a clear section 112 and a filtering section 114 as described above, and according to the embodiment illustrated, all of the flat segments may be substantially identical. The segments 132 may be constructed, for example, of flat segments of quartz glass with a portion having an infrared sapphire coating or coated using another existing infrared filter coating. However, it should be understood by those having skill in the art that the shape, size, and material of the segments 132 may vary without departing from the scope of the disclosure.

Also disclosed in this application is a novel method for switching a searchlight 100 between infrared and white light. This method is described with reference to the above-described apparatus. This method includes the steps of providing a searchlight 100 as described, generally including a housing 102, light source 104, reflector 106, cover 108 and light cover 110. The light cover 110 is positioned about the light source 104 as described above and is movable between first and second positions. In each of the first and second positions either of a clear 112 or filtered section 114, respectively, are positioned to capture light emitted from the light source 104. In ordinary operation, the light source 104 projects light through either the clear section 112 of the light cover 110. In order to adjust the lamp from projecting clear light to infrared light, an actuator 116 may be engaged to move the light cover 110 to the second position, thereby surrounding the light source 104 with the filtered section 114 of the light cover 110. Movement of the light cover 110 may by means of electronic, manual, mechanical, hydraulic, or other known control system.

The above description is intended to demonstrate several embodiments of the disclosed apparatus and is not intended to limit the scope of the invention. Any limitations will appear in the claims as allowed.

What is claimed is:

1. A method of converting the light output from a searchlight from a first light profile to a second light profile, the method comprising the steps of:

providing a searchlight having a reflector and light source;

providing a light cover about the light source, the light cover being substantially cylindrical;

providing the light cover with a first portion constructed of a transparent material whereby light from the light source through the transparent material of the first portion conforms to the first light profile;

providing the light cover with a second portion constructed of a light filtering material whereby light from the light source through the lamp cover conforms to the second light profile;

providing an actuator configured to move the light cover from a first position relative to the light source and reflector, whereby the light source shines through the first portion, to a second position relative to the light source and reflector different from the first position, whereby the lamp shines through the second portion; and providing a light seal around the light cover, thereby preventing light of unwanted wavelengths from leaking out from the lamp cover.

2. The method of claim 1, whereby said first light profile is white light.

3. The method of claim 1, whereby said second light profile is infrared light.

4. The method of claim 1, whereby said light source consists of a xenon lamp.

5. The method of claim 1, whereby said reflector comprises a parabolic reflector.

6. The method of claim 1, whereby said light cover comprises a plurality of flat segments.

7. The method of claim 6, whereby a portion of each of said flat segments includes an infrared filter coating.

8. An apparatus for providing filtered or unfiltered light, the apparatus comprising:

a reflector having an interior and an edge;

a lamp positioned within the interior of the reflector surface;

a light cover concentric about the lamp, the light cover including a first section and a second section, wherein the first section of the lamp is constructed of a transparent material, and wherein light filtering characteristics of the first and second sections are different;

an actuator configured to move the light cover from a first position relative to the light source and reflector to a second position relative to the light source and reflector different from the first position, wherein when the lamp cover is in the first position light from the lamp is projected through the transparent material of the first section and wherein when the lamp cover is in the second position light from the lamp is projected through the second section; and the light cover including a light seal configured to prevent light of unwanted wavelengths from leaking out from the lamp cover.

9. The apparatus of claim 8, wherein said first section is clear to allow said searchlight to be used in a normal operating mode.

10. The apparatus of claim 9, wherein said second section is an infrared filter that prevents visible and ultraviolet light from passing through.

11. The apparatus of claim 10, wherein said filter comprises a coating applied to said lamp cover.

12. The apparatus of claim 8, wherein said actuator is electronically activated.

13. The apparatus of claim 8, wherein said actuator is fixed relative to said lamp.

14. The apparatus of claim 8, wherein said lamp is movable relative to said reflector surface.

15. The apparatus of claim 8, wherein said reflector includes a surface comprising a metal form with a highly reflective coating applied to said interior.

16. A method of manufacturing a searchlight system, the method comprising:

providing a reflector;

providing a light source within the reflector;

providing a plurality of optically transparent flat segments;

applying a filtering coating to a portion of the flat segments to create a filtered section and an unfiltered section, wherein the unfiltered section is constructed of a transparent material;

arranging the flat segments into a substantially cylindrical light cover, and positioning the light cover over the light source within the reflector;

providing an actuator;

attaching the actuator to the light cover in a manner such that the actuator may move the light cover relative to the light source and reflector to expose the light source to either the filtered section in a first position or the unfiltered section in a second position different from the first position; and providing a light seal around the light cover, thereby preventing light of unwanted wavelengths from leaking out from the lamp cover.

17. The method of claim 16, wherein said plurality of flat segments comprise quartz glass or sapphire.

18. The method of claim 17, wherein said filtering coating comprises an infrared coating.

19. The method of claim 18, wherein said infrared coating is applied to half of the flat segments.

20. The method of claim 19, wherein said flat segments are arranged to provide a first unfiltered section and a second filtered section of said cover, said unfiltered section being distal from said filtered section.

* * * * *